US006672782B2

(12) United States Patent
Hsu

(10) Patent No.: US 6,672,782 B2
(45) Date of Patent: Jan. 6, 2004

(54) KEYBOARD STRUCTURE

(75) Inventor: Chien-Shih Hsu, Taipei (TW)

(73) Assignee: Darfon Electronics Corp., TaoYuan (TW)

( * ) Notice: Subject to any disclaimer, the term of this patent is extended or adjusted under 35 U.S.C. 154(b) by 0 days.

(21) Appl. No.: 10/114,276

(22) Filed: Apr. 3, 2002

(65) Prior Publication Data

US 2002/0154931 A1 Oct. 24, 2002

(30) Foreign Application Priority Data

Apr. 6, 2001 (TW) ..... 90205301 U

(51) Int. Cl.[7] ..... B41J 5/16

(52) U.S. Cl. ..... 400/495; 400/490; 400/491.2; 400/495.1; 200/344; 200/345

(58) Field of Search ..... 400/490, 491.2, 400/495, 495.1, 496; 200/344, 345

(56) References Cited

U.S. PATENT DOCUMENTS 4,902,862 A * 2/1990 Oelsch et al. ..... 200/344
5,278,371 A * 1/1994 Watanabe et al. ..... 200/344
5,555,971 A * 9/1996 Takada ..... 200/345
5,767,464 A * 6/1998 Dyer et al. ..... 200/5 A
5,769,210 A * 6/1998 Tsai ..... 200/344
5,813,521 A * 9/1998 Koike et al. ..... 200/344

* cited by examiner

*Primary Examiner*—Daniel J. Colilla
*Assistant Examiner*—Jill E Culler
(74) *Attorney, Agent, or Firm*—Troxell Law Office PLLC

(57) ABSTRACT

A keyboard structure, comprising: a substrate, a scissors mechanism, and a key lid. The scissors mechanism and the substrate are connected together. The scissors mechanism has a rotational configuration formed by cross-connecting a first rod and a second rod. The first rod has a first upper end and a first lower end. The second rod has a second upper end and a second lower end such that the first lower end and the second lower end are connected with the substrate. The key lid is connected with the first upper end and the second upper end for allowing the key lid to move between a first position, wherein the key lid and the substrate are detached, and a second position. The key lid has a base and a stop block. The base is connected with the second upper end of the scissors mechanism. The stop block is kept an appropriate distance with the base. The stop block and the base are formed into a releasing space.

12 Claims, 14 Drawing Sheets

KEYBOARD STRUCTURE

FIELD OF THE INVENTION

The present invention relates to a key lid structure, especially to a kind of keyboard structure that may be applied a force on the key lid to make the key lid and the scissors mechanism directly be separated from the keyboard.

BACKGROUND OF THE INVENTION

In the prior technique for a keyboard of a notebook computer, the key structure is usually constructed by a scissors mechanism on a rubber and relative touch-controlled circuit. A single key structure shown in FIG. 1A, being a three-dimensional illustration for the prior scissors type key structure, wherein the scissors type key structure 1 is arranged on a substrate 10. The scissors type key structure 1 includes: a key lid 12, being provided for direct knocking by a personnel operation, and a scissors mechanism 11, being provided for the up-and-down for the key lid 12. The scissors mechanism 11 is a design of connection rods that is a turn-able scissors configuration formed by doubly symmetrical crossing. An accommodation space is formed at the position between the lower portion of the key lid 12 and the scissors mechanism 11 for providing an arrangement for an elastic body 13 that is returnable after being pressed. The elastic body 13 is a hollow design and made of rubber, silica gel or its composite, and a touch-controlled circuit (not shown in the figure) is then arranged in its interior or on the lower portion of the substrate 10.

Please refer to FIG. 1B, which shows a three-dimensional illustration for the prior key lid structure. The key lid 12 having at least a flange 121, which may provide pivotal match for the turning of the connection rods, and at least a base 122, which may provide pivotal and sliding match for the sliding and turning of the connection rods. In the description hereinafter, for the key lid 12 of the scissors type key structure 1 and the symmetrical scissors mechanism 11, a detailed explanation is made by the manner of side view for a single side of the connection rod, and with exemption of the rubber elastic body 13 and the relative touch-controlled circuit.

Please refer to FIG. 1C, which shows a cross-sectional illustration for the prior scissors type key structure. In the figure, which shows that the scissors mechanism 11 of the scissors type key structure 11 is arranged at the position between the key lid 12 and the substrate 10. Moreover, the scissors mechanism 11 comprises a first rod 111 and a second rod 112. The first rod 111 and the second rod 112 are formed into a scissors type structure that is crossed and able to turn relatively by arranging a pivotal connection point 113 in the middle sections for both connection rods. On the arrangement of the first rod, a pivotal turning match is formed by first upper end 1111 and a flange 121 extended from the key lid 12. While a pivotal sliding match that can glide and turn is then formed by a first lower end 1112 (corresponding to the first upper end 1111) of the first rod 111 and a convex connection trough extended on the substrate 10. On the arrangement of the second rod 112, a pivotal and sliding match that can glide and turn is formed by its second upper end 1121 and a base 122 extended from the key lid 12. While a turning pivotal match is formed by a second lower end (corresponding to the second upper end 1121) of the second rod and a convex connection block 101 extended on the substrate 10.

In the prior scissors type key structure shown in FIG. 1C, the first rod 111 and the pivoted second rod 112 are formed into an up-and-down mechanism of balanced scissors type (i.e. the scissors mechanism 11). The force-applying end is the key lid 12. Two ends of the first rod 111 or the second rod 112 are respectively with the arrangement objects (i.e. the key lid 12 and the substrate 10) to form into a turn-able pivotal match, and a glide-able and turn-able pivotal sliding match. Thereby, during the operation of pressing key, one side of the scissors mechanism 11 (one side containing the first upper end 1111 and the second lower end 1122) is made to keep on same vertical line L, and another side (one side containing the second upper end 1121 and the first lower end 1112) is proceeded an up-and-down, horizontal movement via the abundant stroke of the sliding match.

Since the keyboard apparatus belongs to a necessary product equipped with the peripheries of a computer, and it becomes prevalent in today's usage, in the processes of production and assembly, because of some factors, the scissors mechanism 11 frequently has to be dismantled and reassembled. In the prior scissors type key structure 1, since the internal side of the second upper end 1121 for the key lid 12 is a closed opening type structure, so it is often when the key lid 12 is stripped away upwardly, two connection rods of the scissors mechanism 11 is easily inter-separated, or the lower connection end of the scissors mechanism is separated from the substrate. Furthermore, it would cause the damage for the scissors mechanism and create an occurrence of inconveniently reassembling back. It wastes a redundant assembling time. Or the damage is caused on the scissors mechanism 11 because of too great applying force, and a cost loss is created.

From above description, the prior scissors type key structure 1 has not satisfied the manufacturing requirement for easy reproduction yet, and the improvement for above-mentioned shortcomings to lower down the cost loss in manufacturing processes is really can not be delayed any more.

SUMMARY OF THE INVENTION

The main object of the present invention is to provide a keyboard structure, which can directly separate the key lid from the scissors mechanism by directly applying a force for reducing the damages of: the key lid and scissors mechanism, the disassembly for the scissors mechanism itself, or the separation for the connection state between the scissors mechanism and the substrate during the lifting away process, so the manufacturing cost for assembly and repair could be lowered down and the competing ability for manufacturing is promoted.

To achieve above-mentioned objects, a keyboard structure of the present invention, comprising: a substrate, a scissors mechanism, and a key lid.

The scissors mechanism and the substrate are connected together. The scissors mechanism has a rotational configuration formed by cross-connecting a first rod and a second rod. The first rod has a first upper end and a first lower end. The second rod has a second upper end and a second lower end such that the first lower end and the second lower end are connected with the substrate.

The key lid is connected with the first upper end and the second upper end for allowing the key lid to move between a first position, wherein the key lid and the substrate are detached, and a second position. The key lid has a base and a stop block. The base is connected with the second upper end. The stop block is kept an appropriate distance with the base. The stop block and the base are formed into a releasing space.

In another preferable embodiment of the present invention, the key lid may also be designed into a different embodiment. Namely, the key lid is connected with the first upper end and the second upper end for allowing the key lid to move between a first position, wherein the key lid and the substrate are detached, and a second position. The key lid has a base and a stop block. The base is connected with the second upper end. The stop block, whose one end is connected with the base and whose other end and the base is separated by a gap.

In another preferable embodiment of the present invention, the second upper end has a decided diameter shaft, and the key lid may also be designed into a different embodiment. Namely, the key lid is connected with the first upper end and the second upper end for allowing the key lid to move between a first position, wherein the key lid and the substrate are detached, and a second position, bottom of the key lid has a base that connected with the shaft of sliding and turning, when the key lid more to the first position, the shaft slides into one side of the base that has a decided width opening hole, and the opening hole width is smaller than the shaft diameter.

For you're esteemed reviewing committee to further understand and recognize the present invention, a detailed description cooperative with a plurality of drawings are presented as following.

DETAILED DESCRIPTION OF THE PREFERRED EMBODIMENT

The major characteristic for the keyboard structure of the present invention is a releasing space arranged to the key lid. Applying direct force on the key lid may make the glide-able and turn-able connection rods with pivotal and sliding match escape away by the releasing space to achieve the function of non-damage for the key lid and the scissors mechanism during the separation process of applying force.

Figure 1A:
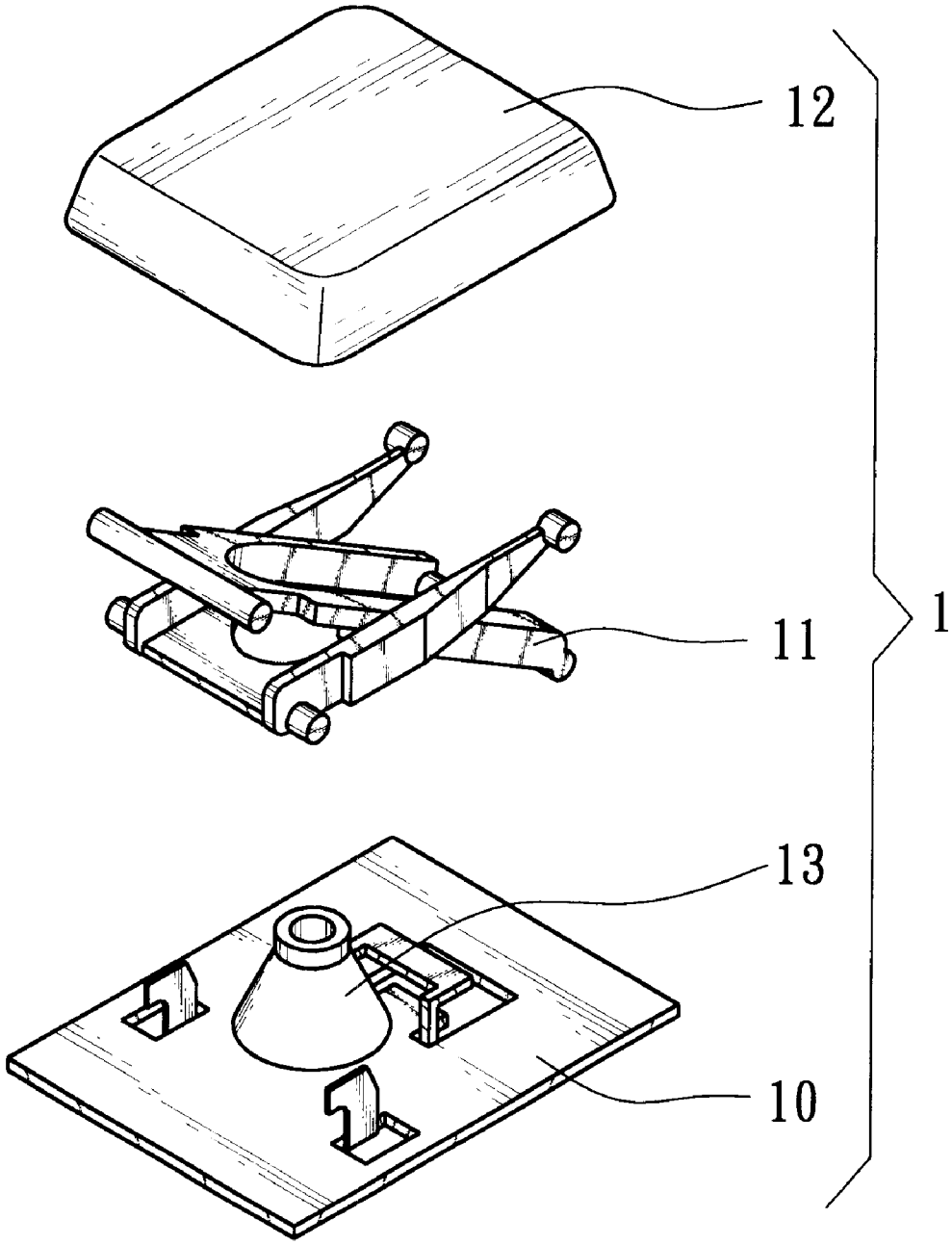
FIG. 1A (PRIOR ART)
FIG. 1A is a three-dimensional illustration for the prior key structure with scissors type.
Figure 1B:
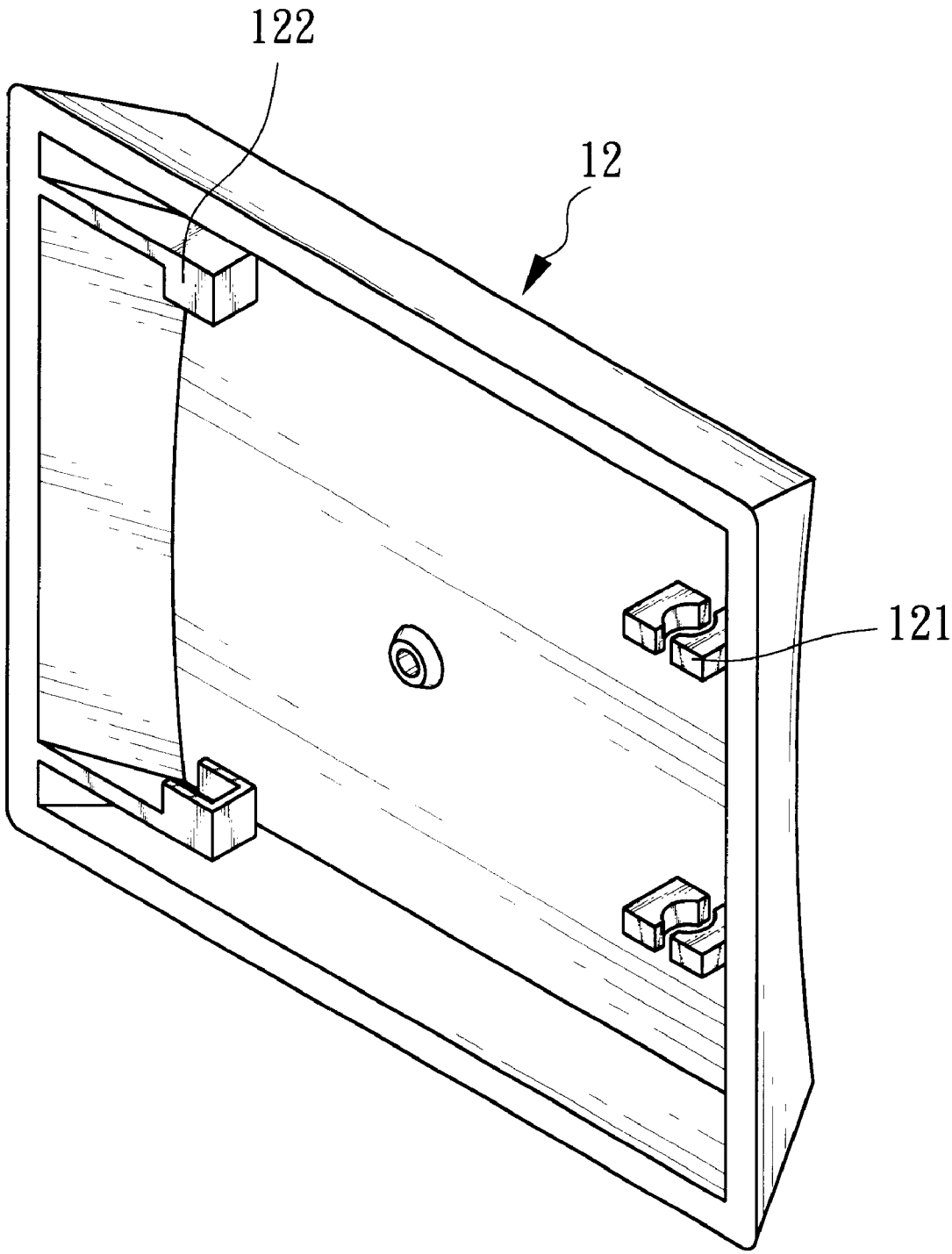
FIG. 1B (PRIOR ART)
FIG. 1B is a three-dimensional illustration for the prior key lid structure.
Figure 1C:
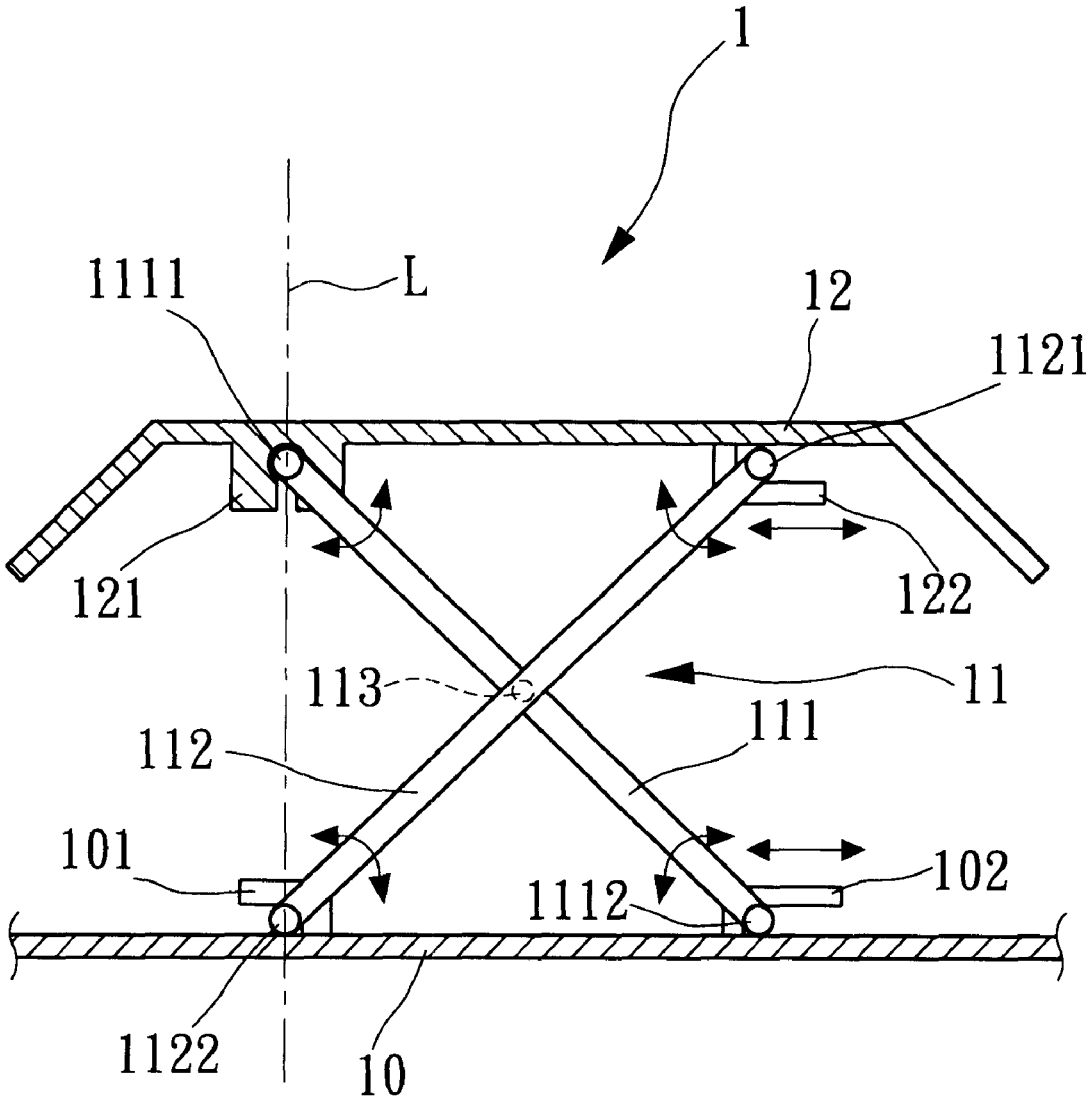
FIG. 1C (PRIOR ART)
FIG. 1C is a cross-sectional illustration for the prior key structure with scissors type.
Figure 2:
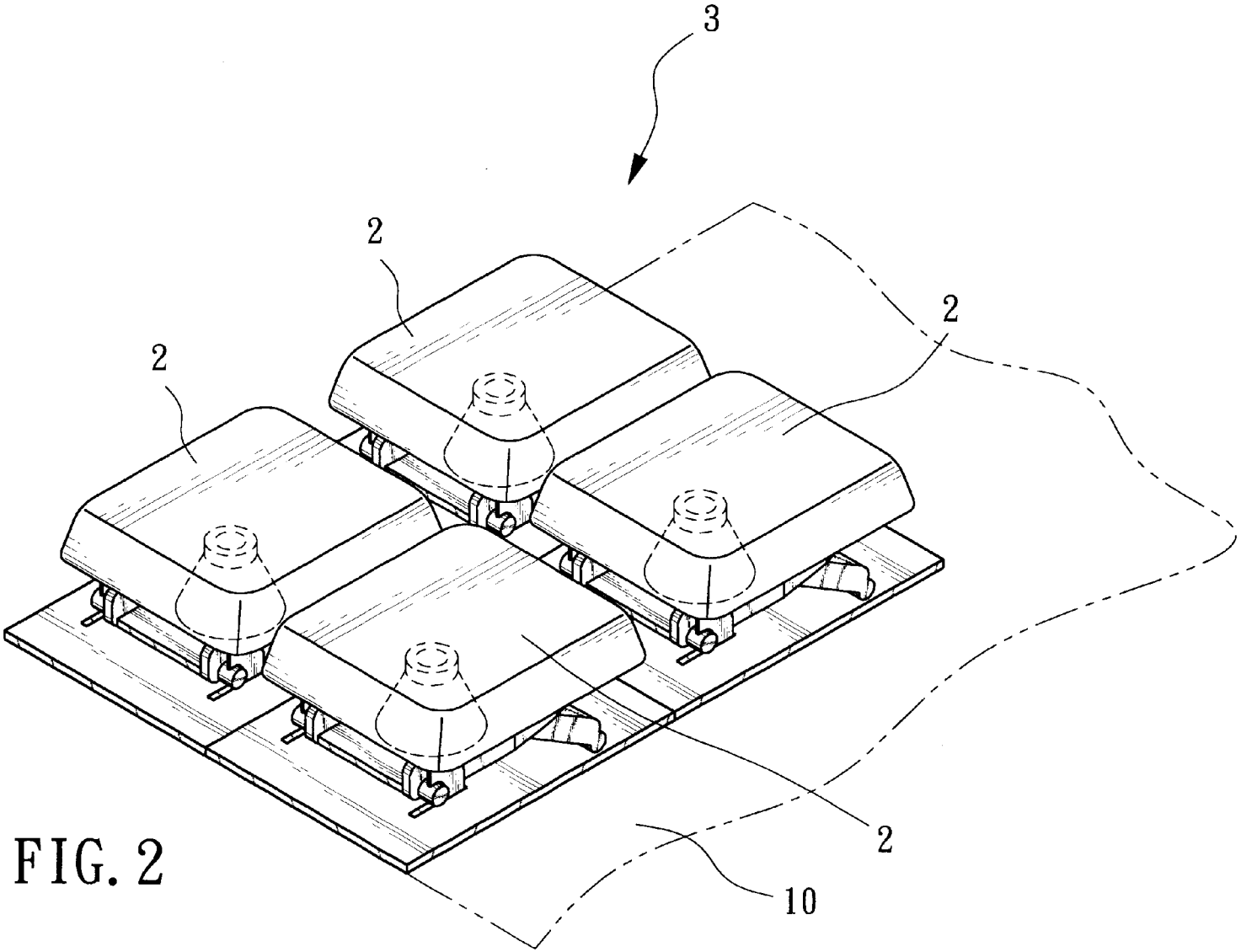
FIG. 2 is a preferable embodiment illustration for a keyboard structure or the present invention.
Figure 3A:
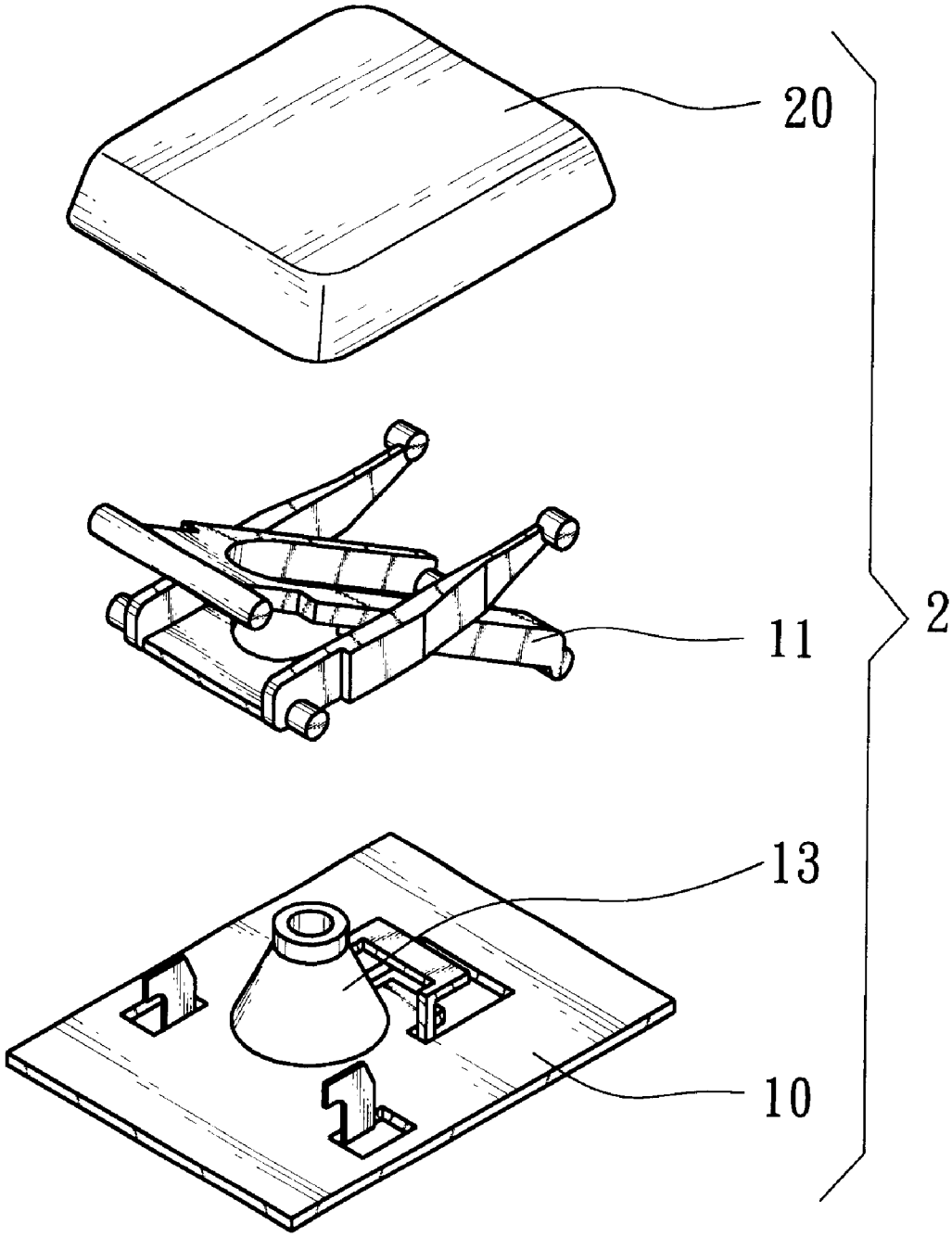
FIG. 3A is a three-dimensional separation illustration for a preferable embodiment for a single keyboard structure of the present invention.
Figure 3B:
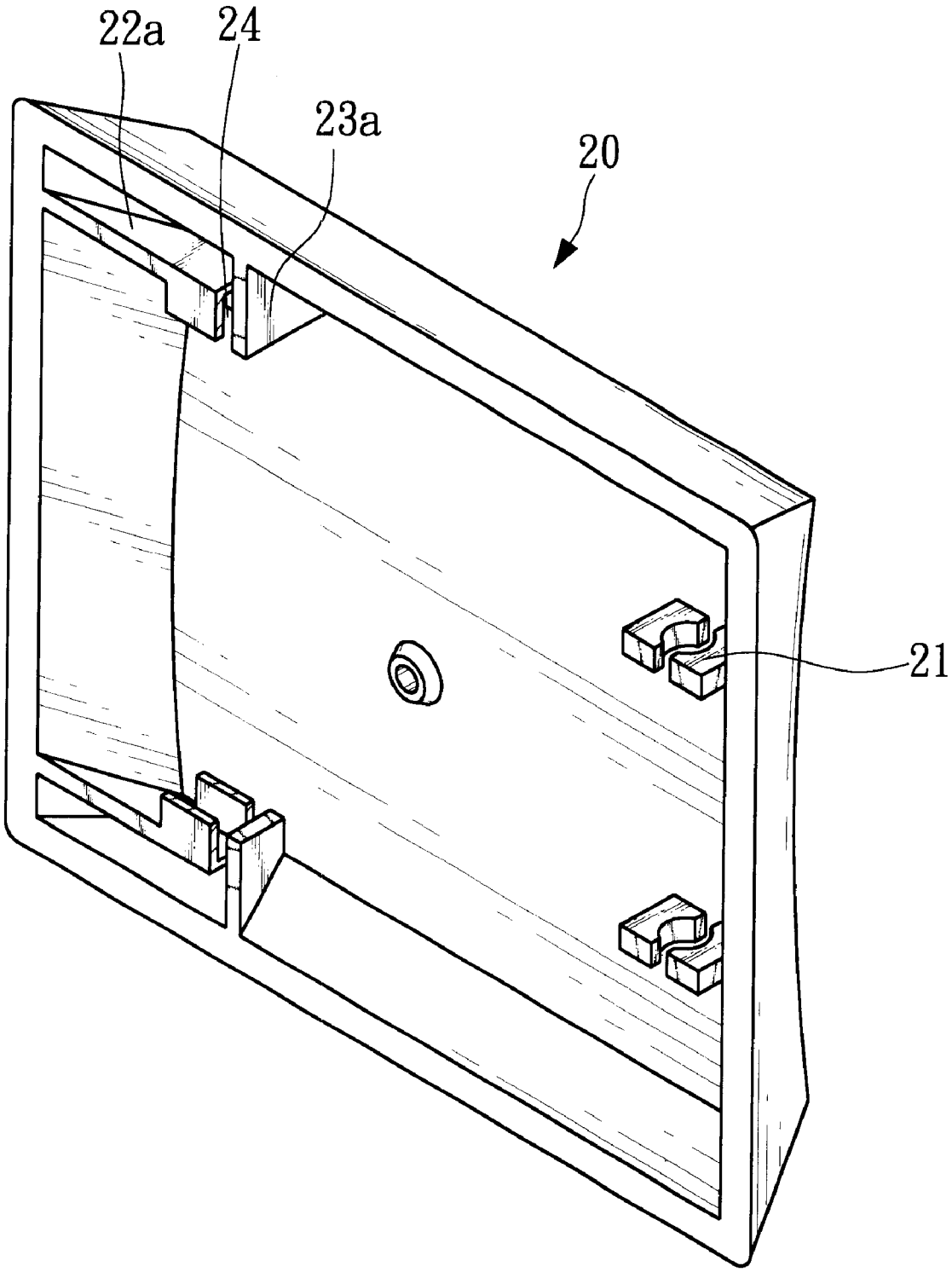
FIG. 3B is a three-dimensional illustration for the first embodiment for the key lid structure of the present invention.
Figure 3C:
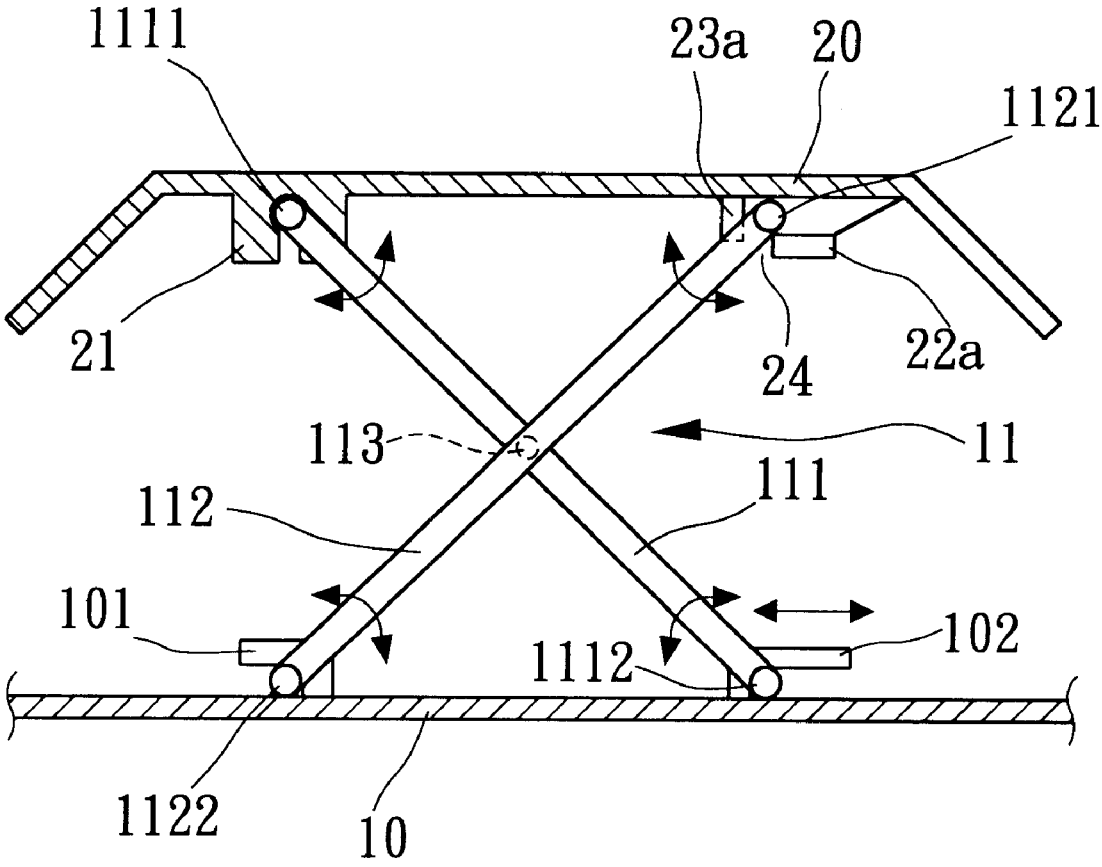
FIG. 3C is a cross-sectional illustration for a preferable embodiment for a keyboard structure of the first present invention.
Figure 3D:
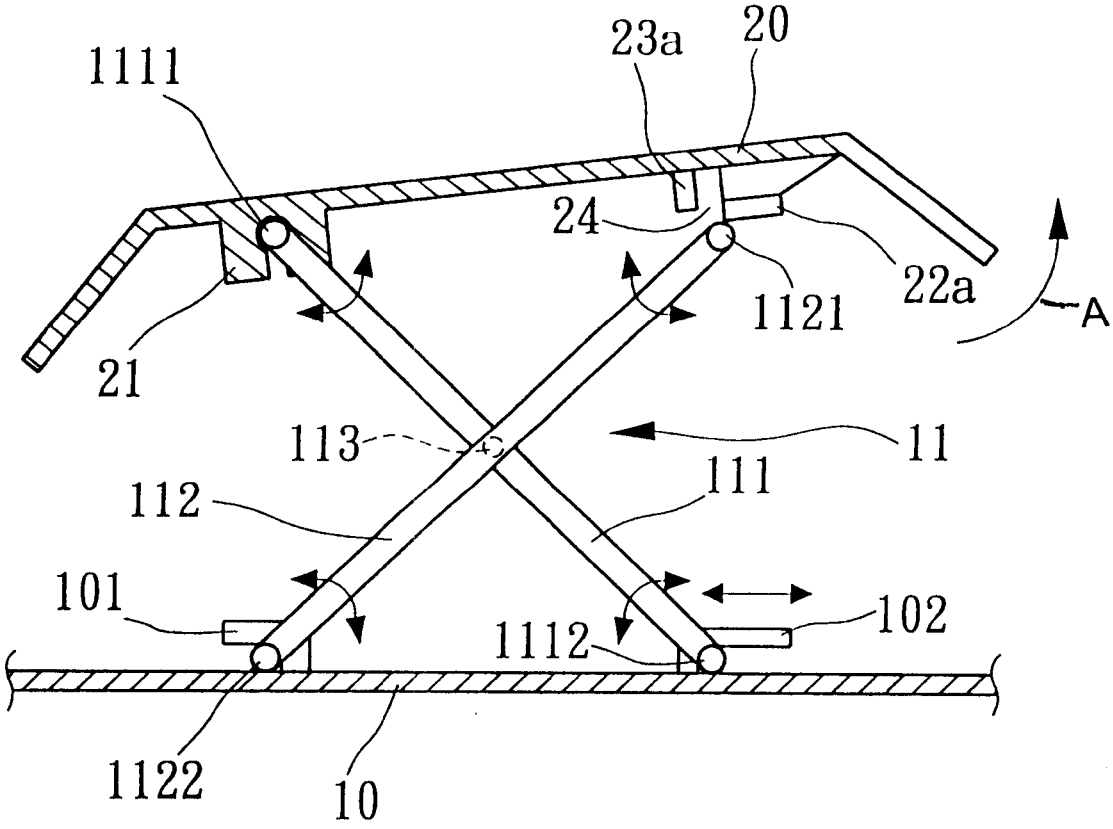
FIG. 3D is a separation cross-sectional illustration for a keyboard structure of the first present invention.

Please refer to FIG. 2, which shows a structure illustration for a preferable embodiment for the keyboard structure of the present invention. The present invention is applied on a keyboard of a personal computer or a keyboard of a notebook computer. Plural lift-able top-lid key structures 2 are arranged on a substrate 10 of a keyboard apparatus 3 to provide direct knocking key-in for operation personnel. In order to describe and explain easily, a detailed description with a single lift-able top-lid key structure 2 is presented as following.

Please refer to FIG. 3A to FIG. 3D, which show the structure illustrations for the preferable embodiment for a keyboard structure of the present invention. The keyboard structure 2 of the present invention includes a substrate 10, a scissors mechanism 11, and a key lid 20.

The scissors mechanism 11 and the substrate 10 are connected with each other. The scissors mechanism 11 has a first rod 111 and a second rod 112. Tie first rod 111 and the second rod 112 are formed into a scissors configuration that is inter-crossed and able to turn relatively by arranging a pivotal connection point 113 in the middle sections for both connection rods. Wherein the first rod 111 has a first upper end 1111 and a first lower end 1112. The first lower end 1112 and a convex connection trough 102 extended out on the substrate 10 are formed into a pivotal sliding match capable of sliding and turning. The second rod 112 has a second upper end 1121 and a second lower end 1122. The second lower end 1122 and a convex connection block 101 extended out on the substrate 10 are formed into a pivotal match capable of turning.

The key lid 20 can be connected with the scissors mechanism 11 to make the key lid 20 to move between a first position and a second position of the substrate 10. The key lid 20 at least have: a flange 21, with which the first upper end 1111 of the scissors mechanism 11 are formed into a pivotal match capable of turning, a base 22*a*, with which the second upper end 1121 of the scissors mechanism 11 are formed into a pivotal sliding match capable of sliding and turning. Two side ends of the base 22*a* are formed into opening type, and a stop block 23*a* is kept an appropriate distance with the internal side end of the base 22*a*. A releasing space 24 is formed between the stop block 23*a* and the base 22*a*. The width of the releasing space 24 is a little smaller than the diameter of the second upper end 1121, so in the pivotal sliding match motion of sliding and turning, it will not happen that the second upper end 1121 of the second rod 112 would be separated from the base 22*a* because the releasing space is too large. In separating the key lid 20 from the scissors mechanism 11, wherein a force, such as the force illustrated in FIG. 3D moving in direction A, is applied on the key lid 20, at this time, the second upper end 1121 is touched to the stop block 23*a*, and since the releasing space 24 is a little smaller than the diameter of the second upper end 1121, so the stop block 23*a* should be restricted within the releasing space 24. Further more, since the base 22*a* with the stop block 23*a* and the key lid 20 are formed into one body, and the second upper end 1121 is one end of the second rod 112, so all these are composed of materials of plastic or its composite. Since these elastic devices have some elasticity, so when an appropriate force, such as the force illustrated in FIG. 3D moving in direction A, is applied, the second rod 112 is then made to separate from the key lid 20. And since these elastic devices are operated within the elastic deformation zone and not reached the plastic deformation, so damage or permanent deformation cannot be created. They can be used repetitiously.

Figure 4A:
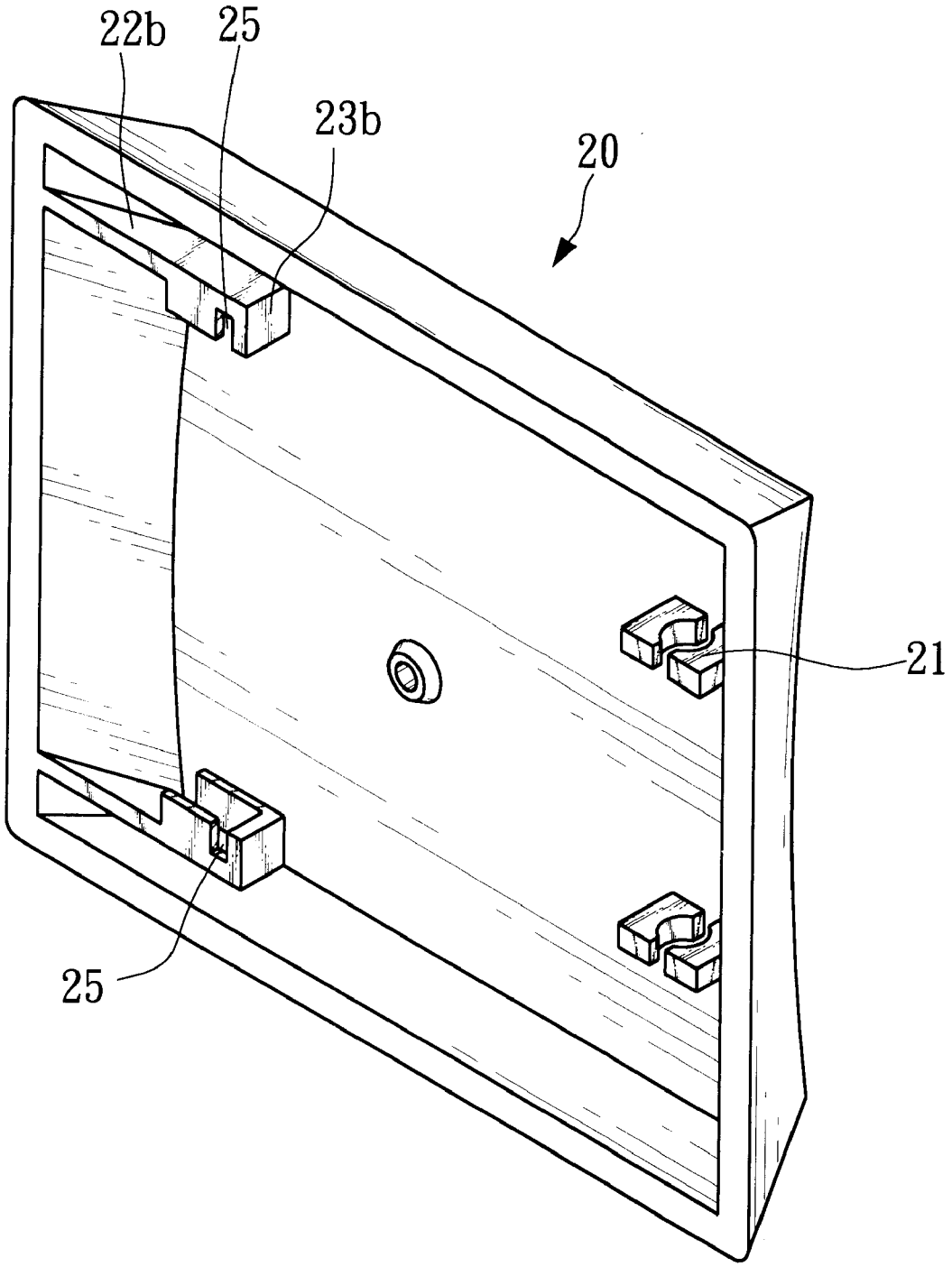
FIG. 4A is a three-dimensional illustration for the second embodiment for the key lid structure of the present invention.
Figure 4B:
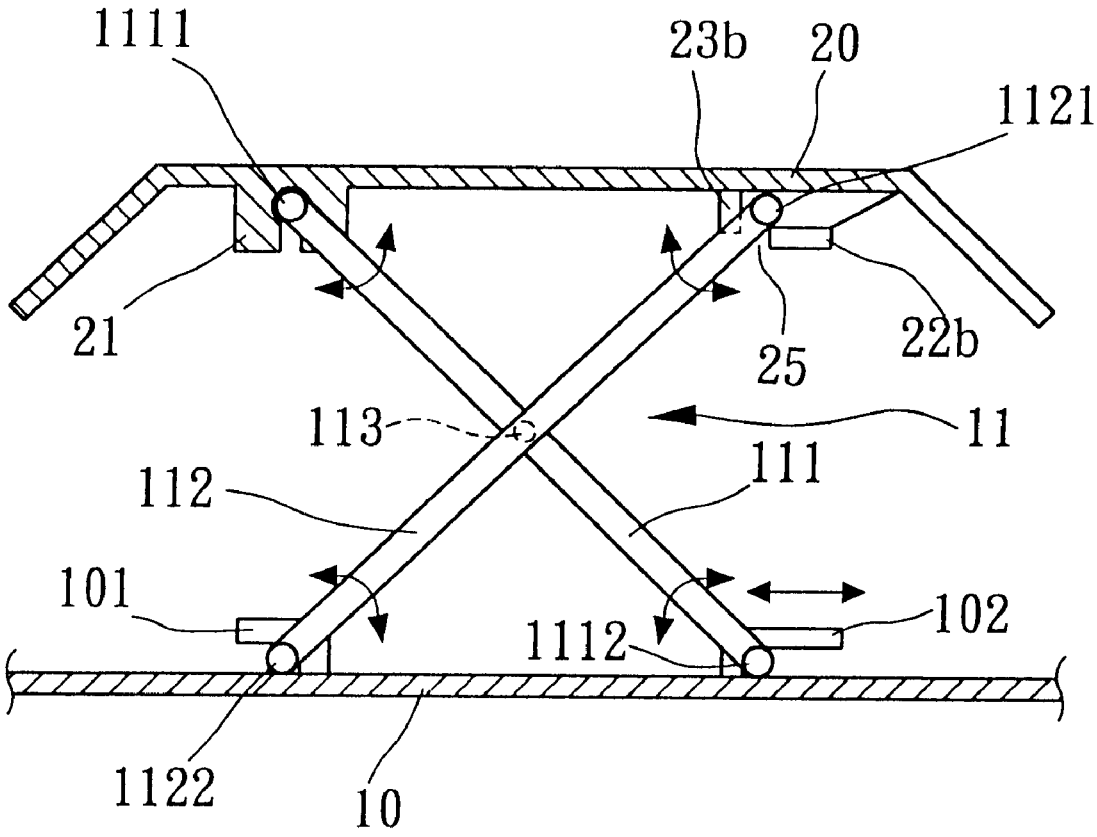
FIG. 4B is a cross-sectional illustration for a preferable embodiment for a keyboard structure of the second present invention.
Figure 4C:
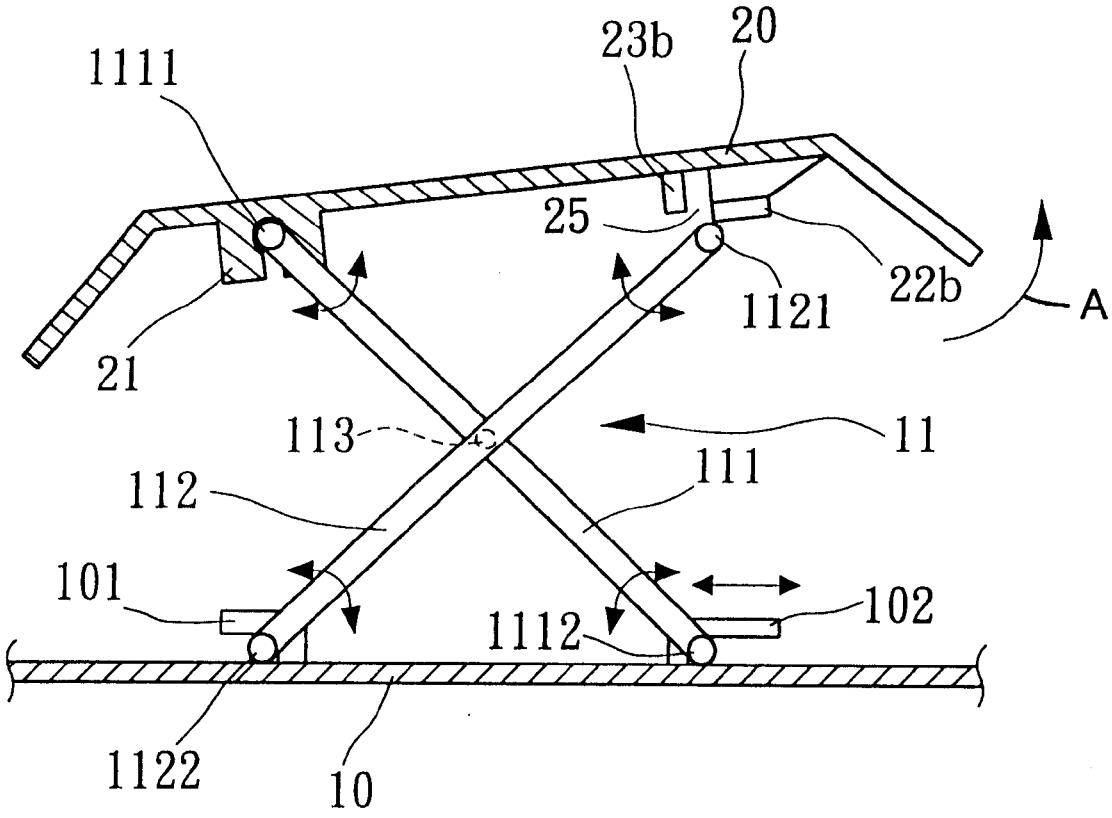
FIG. 4C is a separation cross-sectional illustration for a keyboard structure of the second present invention.

Please refer to FIG. 4A to FIG. 4C, which show the structure illustrations for the second embodiment for the key lid structure of the present invention. The design of the key lid 20 of the present invention may also be that one end of the stop block 23*b* and the base 22*b* are connected together. Another end is an opening 25 that is kept an appropriate distance with the base 22*b,* wherein the opening 25 is a little smaller than the diameter of the second upper end 1121, so in the pivotal sliding match motion of the sliding and turning, it would not cause the second rod 112 to drop out because the opening 25 is too large to influence the smoothness for the motion. There are lots of derivations for this kind of mechanism. The variation mechanisms of this sort are well known to the persons who are skilled in this technique and really within the definition scopes of the present invention. In separating the key lid 20 from the scissors mechanism 11, wherein a force, such as the force illustrated in FIG. 40 moving in direction A, is applied on the key lid 20, at this time, the second upper end 1121 is touched to the stop block 23*b,* and since the opening 25 is a little smaller than the diameter of the second upper end 1121, so the stop block 23*v* should be restricted within the opening 25. Further more, since the base 22*b* with the stop block 23*b* and the key lid 20 are formed into one body, and the second upper end 1121 is one end of the second rod 112, so all these are composed of materials of plastic or it composite. Since these elastic devices have some elasticity, so when an appropriate force, such as the force illustrated in FIG. 4C moving in direction A, is applied, the second rod 112 is then made to separate from the key lid 20. And since these elastic devices are operated within the elastic deformation zone and not reached the plastic deformation, so damage or permanent deformation cannot be created. They can be used repetitiously.

Figure 5A:
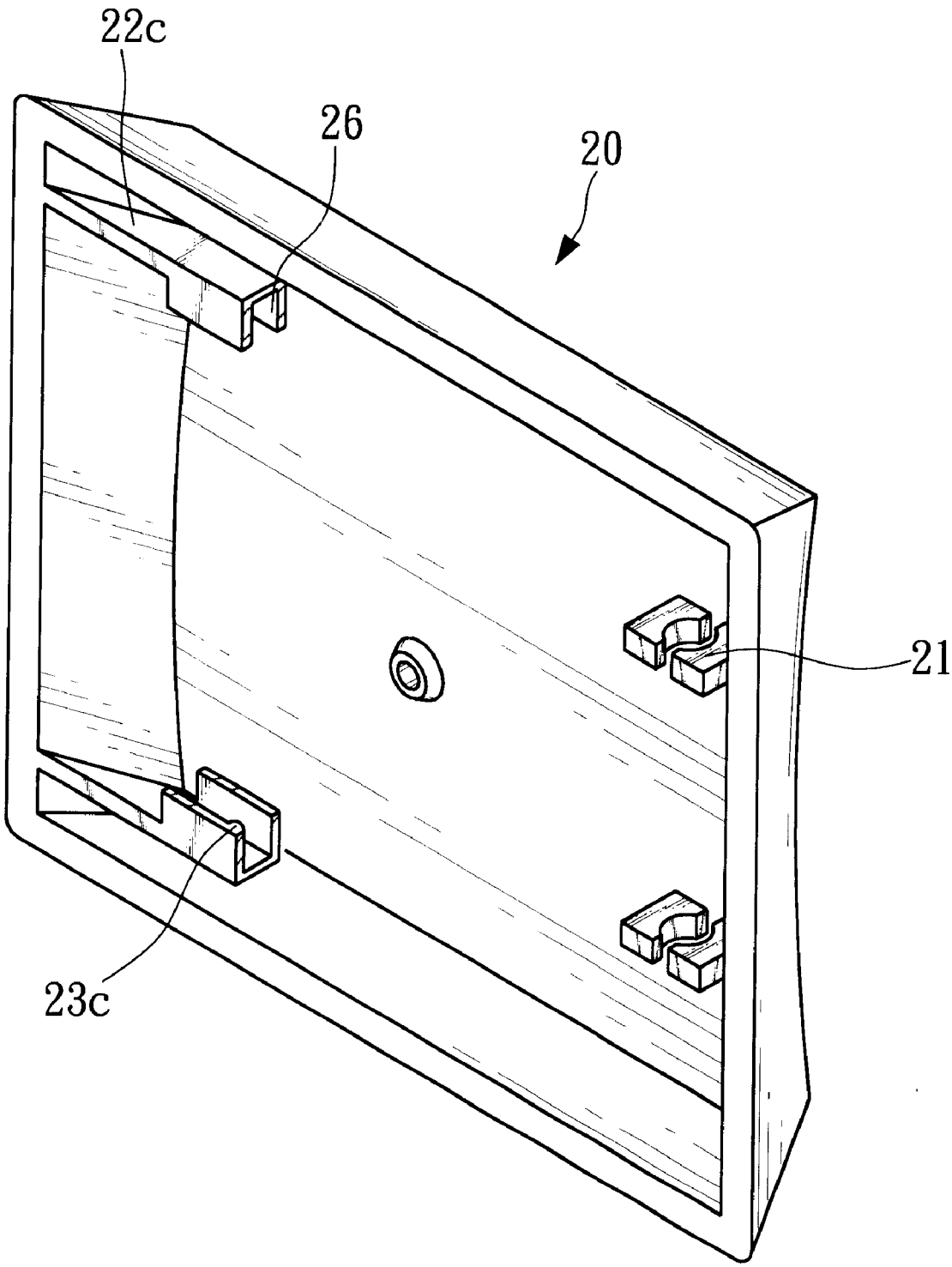
FIG. 5A is a three-dimensional illustration for the third embodiment for the key lid structure of the present invention.
Figure 5B:
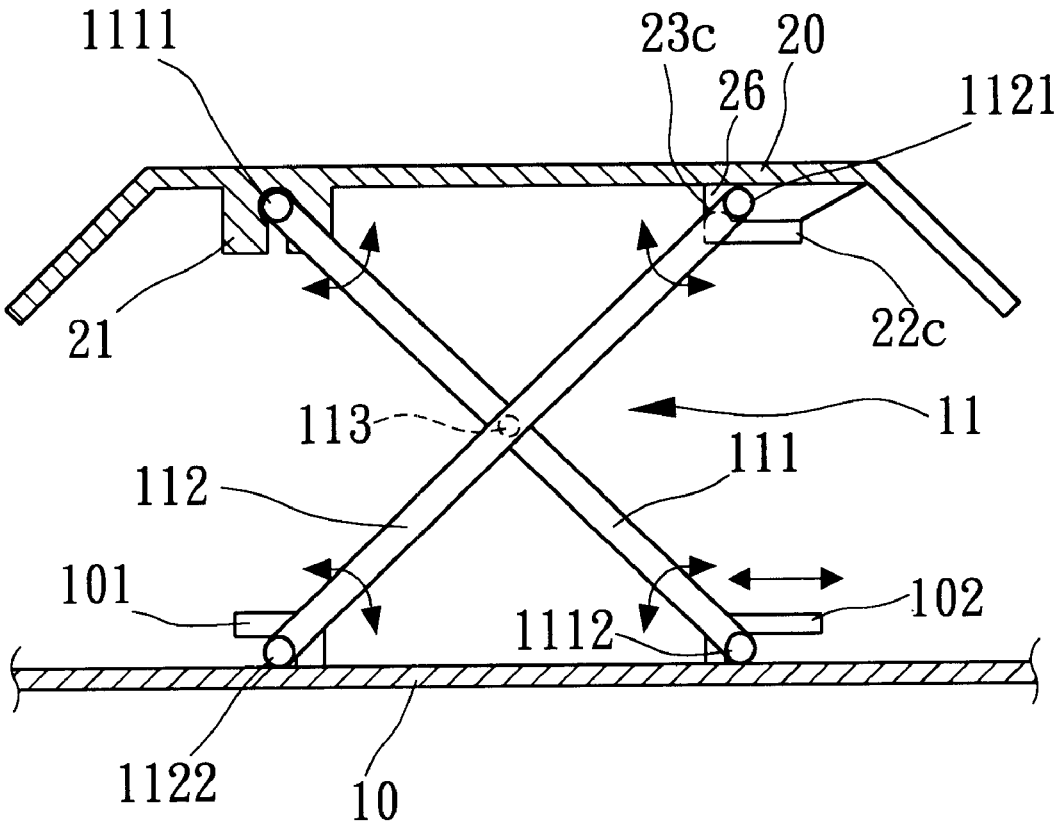
FIG. 5B is a cross-sectional illustration for a preferable embodiment for a keyboard structure of the third present invention.
Figure 5C:
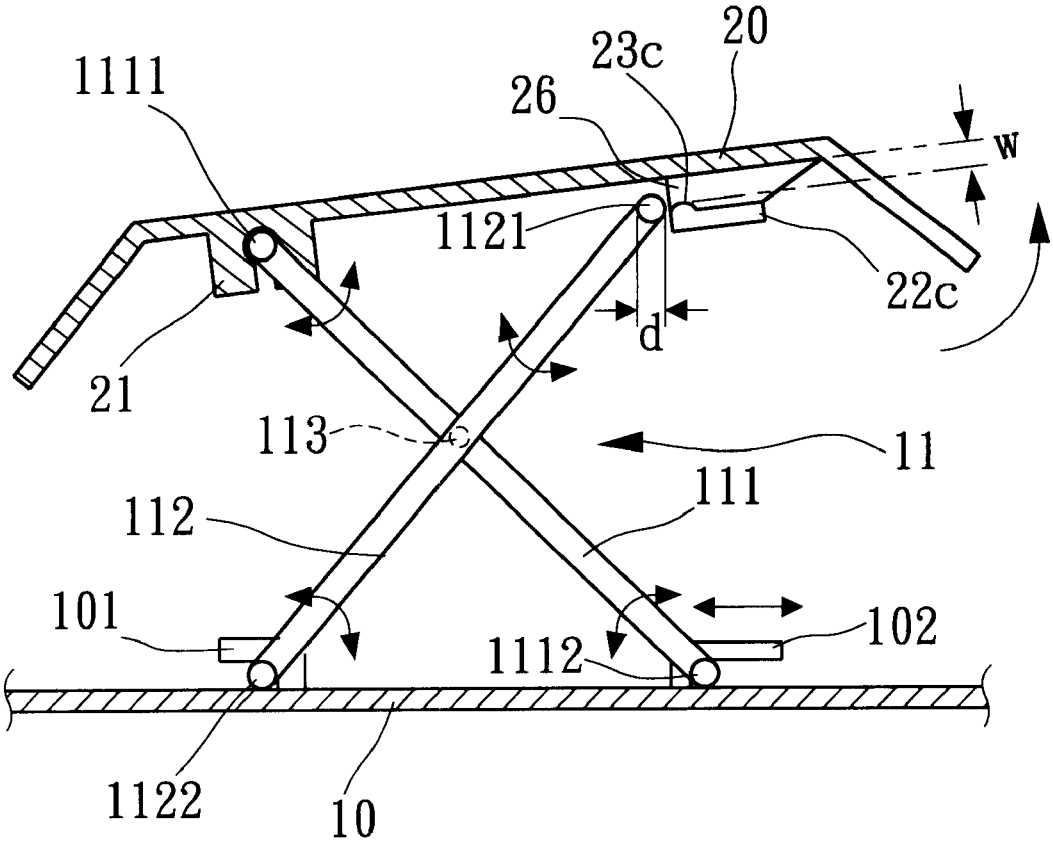
FIG. 5C is a separation cross-sectional illustration for a keyboard structure of the third present invention.

Please refer to FIG. 5A to FIG. 5C, which show the structure illustrations for the third embodiment for the key lid structure of the present invention. The second upper end 1121 has a decided diameter (d) shaft, and the key lid 20 may also be designed into a different embodiment. Namely, bottom of the key lid 20 has a base 22*c* that connected with the shaft of sliding and turning, when the key lid 20 move to the first position, the shaft slides into one side of the base 22*c* that has a decided width (w) opening hole 26, and the opening hole 26 width (w) is smaller than the shaft diameter (d). The opening hole 26 has at least one stop block 23*c* that sets on top of the base 22*c* or sets on bottom of the key lid 20. Of course, the stop block 23*c* can be designed semi arc or rectangle. In separating the key lid 20 from the scissors mechanism 11, wherein a force is applied on the key lid 20, at this time, the opening hole 26 width (w) can be larger smaller than the shaft diameter (d). Since these elastic devices have some elasticity, so when an appropriate force is applied, the second rod 112 is then made to separate from the key lid 20. And since these elastic devices are operated within the elastic deformation zone and not reached the plastic deformation, so damage or permanent deformation cannot be created. They can be used repetitiously. The preferable lift-able top-lid key structure 2 of the present invention may comprise an elastic body 13, being arranged at the position between the substrate 10 and the key lid 20, by elasticity the key lid 20 is made to move from the second position to the first position. The elastic body 13 is a hollow design and made of materials of rubber, silica gel, or their composite, etc. Relative touch-controlled circuit (not shown in the figures) is then arranged in the interior of the elastic body 13 or on the lower portion of the substrate 10.

In above-mentioned keyboard structure of the present invention, when a force is directly applied on the key lid to make the connection rods of pivotal sliding match capable of sliding and turning escape away with the releasing space, a function of non-damage for both key lid and scissors mechanism because of the separation caused by applying force is reached and a shortcoming of the prior technique is really overcome, so the manufacturing requirement is fulfilled and the competition ability of the industry is promoted.

What is claimed is:

1. A keyboard structure, comprising:

a substrate;

a scissors mechanism, being connected with the substrate and having a first rod and a second rod, wherein the first rod has a first upper end and a first lower end and the second rod has a second upper end and a second lower end, the first rod and the second rod are pivotally connected at middle sections thereof, the first lower end and the second lower end are connected with the substrate; and a key lid, connected with the first upper end and the second upper end allowing the key lid to move from a first position, where the key lid and the substrate are spaced apart toward the substrate, said key lid having:

a base having an open end connecting with the second upper end; and a stop block, forming a releasing space with the open end, wherein the releasing space is smaller than a diameter of the second upper end, such that when a force is applied in a direction from the substrate toward the first position, the second upper end is separated from the key lid when the key lid is in the first position.

2. The key board structure of claim 1, wherein the first lower end is pivotally and slidably connected to the substrate.

3. The keyboard structure of claim 1, wherein the key lid further comprises a flange into which the first upper end is pivotally connected.

4. The keyboard structure of claim 1, wherein the second lower end is pivotally connected to the substrate.

5. The keyboard structure of claim 1, wherein the second upper end is pivotally and slidably connected to the base.

6. The keyboard structure of claim 1, further comprising an elastic body positioned between the substrate and the key lid, moving the key lid toward the first position.

7. A keyboard structure, comprising:

a substrate;

a scissors mechanism, connected with the substrate and having a rotational configuration formed by cross-connecting a first rod and a second rod, wherein the first rod has a first upper end and a first lower end and the second rod has a second upper end and a second lower end such that the first lower end and the second lower end are connected with the substrate; and a key lid, connected with the first upper end and the second upper end, the key lid movable between a first position, where the key lid and the substrate are spaced apart, and a second position where the key lid is adjacent to the substrate, said key lid having:

a base connecting with the second upper end; and a stop block, having a first end connected with the base, and a second end separated from the base by an opening having a width smaller than a diameter of the second upper end, such that when a force is applied in a direction from the second position toward the first position, the second upper end is separated from the key lid when the key lid is in the first position.

8. The keyboard structure of claim 7, wherein the first lower end is pivotally and slidably connected to the substrate.

9. The keyboard structure of claim 7, wherein the key lid further comprises a flange, into which the first upper end is pivotally connected.

10. The keyboard structure of claim 7, wherein the second lower end is pivotally connected to the substrate.

11. The keyboard structure of claim 7, wherein the second upper end is pivotally and slidably connected to the base.

12. The keyboard structure of claim 7, further comprising an elastic body positioned between the substrate and the key lid moving the key lid from the second position to the first position.

* * * * *